US005493079A

United States Patent [19]

Anderson

[11] Patent Number: 5,493,079

[45] Date of Patent: Feb. 20, 1996

[54] VOCAL COMMUNICATION SNORKEL

[76] Inventor: C. Roger Anderson, 2726 Hawthorne La., Wilmette, Ill. 60091

[21] Appl. No.: 298,139

[22] Filed: Aug. 30, 1994

[51] Int. Cl.[6] ..... G10K 11/00

[52] U.S. Cl. ..... 181/127; 181/21; 128/201.11; 367/132

[58] Field of Search ..... 181/18, 21, 126, 181/127, 141; 128/201.11, 201.19; 367/132

[56] References Cited

U.S. PATENT DOCUMENTS

| | | | |
|---|---|---|---|
| 2,844,212 | 7/1958 | Hogan et al. . | |
| 3,174,129 | 3/1965 | Laughlin et al. . | |
| 3,210,723 | 10/1965 | Martelli et al. . | |
| 3,348,539 | 10/1967 | McDonald . | |
| 3,828,887 | 8/1974 | Alexander . | |
| 4,031,888 | 6/1977 | Walters | 128/201.11 |
| 4,071,110 | 1/1978 | Payne . | |
| 4,183,422 | 1/1980 | Williams . | |
| 4,527,657 | 7/1985 | Payne . | |
| 4,852,682 | 8/1989 | Benjamin . | |

OTHER PUBLICATIONS

"Mighty Mouth" by Jack McKenney, *Skin Diver*/Jul. 1969, pp. 38, 39, and 76.

*Primary Examiner*—Khanh Dang
*Attorney, Agent, or Firm*—Nicholas A. Camasto

[57] ABSTRACT

A vocal communication snorkel includes a hollow body having a breather tube, adapted to extend above the water, coupled thereto and a mouthpiece adapted to be held by the lips of a snorkeler. The body has a pair of inwardly curved, spherically shaped diaphragms of thin plastic material that are tuned to resonance within the frequency band of 1500 to 3000 Hertz in water. The mouthpiece includes a passageway that is coupled to the body and a pair of flexible lips, that are closable by the lips of the snorkeler for articulating plosive sounds. A readily collapsible bubble, formed in the passageway and engageable by the lower lip of the snorkeler, facilitates closure of the passageway under pressure from the snorkeler's lower lip.

11 Claims, 1 Drawing Sheet

VOCAL COMMUNICATION SNORKEL

BACKGROUND OF THE INVENTION

This invention relates generally to underwater communication devices and specifically to a simple, low cost, passive vocal communication snorkel. The art has long attempted to develop a passive, voice-powered communication device for enabling underwater communication. These devices were intended for use by scuba divers who carry tanks of compressed air for breathing. The stream of exhaust air bubbles, emitted from the swimmer's regulator, creates an ambient noise problem that renders intelligible underwater communication very difficult indeed.

A snorkeler, however, generally swims (or floats) just beneath the surface of the water and breathes through a breather tube that extends above the surface of the water. The breather tube is fitted to a mouthpiece that is held in the snorkeler's mouth. Since there is no stream of air bubbles being emitted, the ambient noise is much less of a problem. Yet, to date, there has been no successful passive underwater voice communication snorkel developed.

The characteristic impedance of water is 3600 times higher than that of air and therefore the communication of sound vibrations across an air water interface involves significant losses. The wavelength of sound in water is about 4.4 times greater than in air, hence a diaphragm size of 3 inch diameter, for example, is rather small to efficiently radiate voice frequencies in water. Consequently, such a diaphragm will exhibit substantial mass loading and reduced radiation impedance.

The base frequencies of the vocal chords, i.e. 100–200 Hertz, are normally suppressed when speaking in an air medium because the mouth area is too small to radiate them efficiently. These frequencies experience an increase of from 20–30 dB when speaking into a small enclosure such as a mask, a tube or the like. Additionally, a person's cheeks, throat and chest vibrate with low frequency sound, which is communicated to the water, forming a mass of unintelligible sound. This severely affects the intelligibility of the sound and is a major problem in developing a successful passive voice communication snorkel.

The voice communication snorkel of the invention solves many of the problems enunciated above. The preferred embodiment uses a pair of molded 0.008–0.014 inches thick, spherically shaped, polyester diaphragms that are mounted with an inward curve to decrease the volume of the cavity in the hollow snorkel body and to minimize the possibility of mechanical damage. The in-air resonance of the diaphragms are in the range of 3000 to 6000 Hertz. The mass loading of the water reduces their in-water resonance frequency to 1500–3000 Hertz. At the resonance frequency, the mass loading of the diaphragms is canceled by the stiffness of the diaphragm, and sound vibrations are coupled into the water. This supplies the higher voice frequencies which are necessary for intelligibility. While a two diaphragm snorkel is the preferred embodiment, a single diaphragm model will work, although with poorer intelligibility. Three or more diaphragms may be used with somewhat better results. In all multiple diaphragm cases, the individual diaphragms should be tuned to resonate at slightly different, overlapping frequencies to maximize the efficiency in covering said frequency range.

A major feature of the inventive snorkel is the mouthpiece containing a passageway that functions as a pair of "rubber lips", allowing air to be inhaled easily and yet providing for articulation of the exhaled air. This passageway is controlled by the lips of the snorkeler. A readily collapsible bubble is formed in the throat of the mouthpiece for engagement by the lower lip of a snorkeler. The bubble may be collapsed by minimal pressure from the snorkeler's lower lip to close the throat and help articulate plosive sounds.

OBJECTS OF THE INVENTION

A principal object of the invention is to provide a novel voice communication snorkel.

Another object of the invention is to provide a passive means for enabling short distance, intelligible underwater communication between snorkelers.

A further object of the invention is to provide an improved snorkel breathing apparatus.

BRIEF DESCRIPTION OF THE DRAWINGS

These and other objects and advantages of the invention will be apparent upon reading the following description in conjunction with the drawings, in which.

DESCRIPTION OF THE PREFERRED EMBODIMENT

Figure 3:
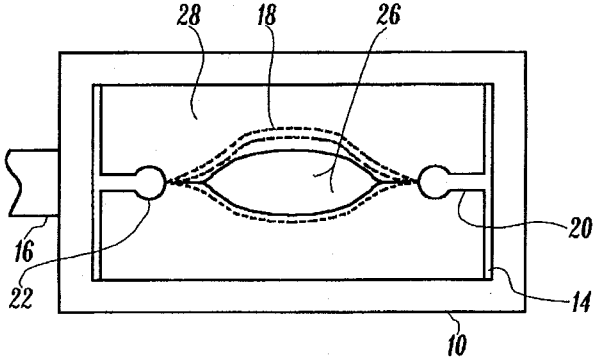
FIG. 3 is a top view of the snorkel of FIG. 1.
Figure 2:
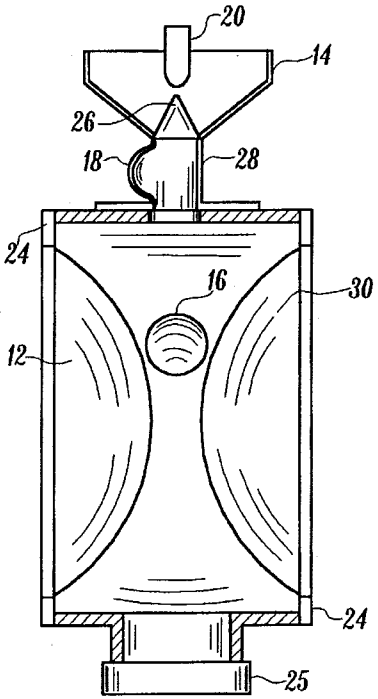
FIG. 2 is a sectional side view of the snorkel of FIG. 1.
Figure 1:
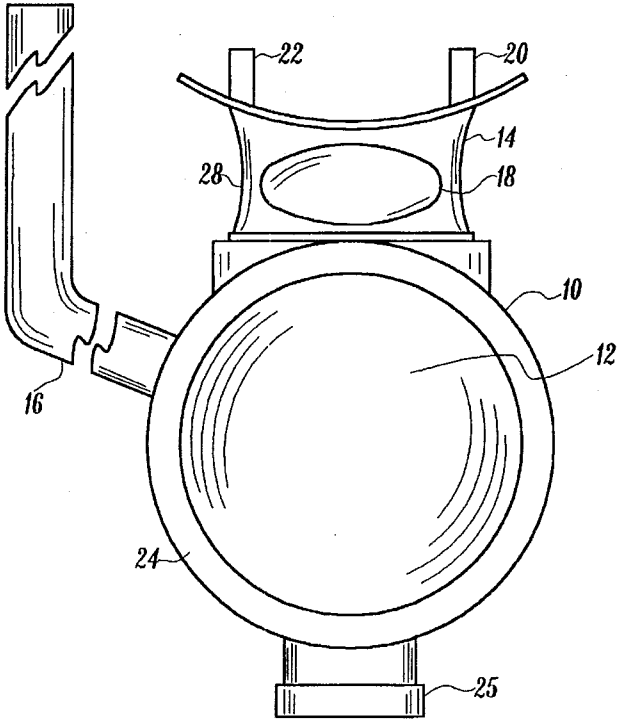
FIG. 1 is a plan view of a snorkel constructed in accordance with the invention.

Referring to FIGS. 1–3, the snorkel of the invention includes a hollow, generally disk shaped body 10 with a pair of inwardly curved hemispherical diaphragms 12 and 30 affixed to opposite sides thereof. The volume between the inwardly curved diaphragms 12 and 30 comprises an air chamber to which is coupled a conventional breathing tube 16 that is adapted to extend above the surface of the water to enable the user to inhale and exhale air. A mouthpiece 14 is coupled to body 10 and defines an elongated, relatively narrow passageway or throat 28 that communicates with the interior of body 10. A relatively large flange fits between the user's front teeth and the inside of the lips, securing the mouthpiece in place. A pair of bits 20 and 22 are adapted to be held, when necessary, between the clenched teeth of the snorkeler with the snorkeler's lips engulfing the mouthpiece 14 and engaging the entrance of passageway 28. Pressure from the snorkeler's lips enables the interior of passageway 28 to be collapsed to substantially close off the air communication between the mouthpiece and body 10 for articulating plosive sounds. Diaphragms 12 and 30 may be sealed in body 10 by any well known watertight sealing technique, with a seal ring 24 being shown. The body may be made of metal or any other rigid material. In a practical embodiment, the body is of molded plastic with the diaphragms being held in position by means of seal rings 24 which may be secured by cementing, ultrasonic welding, or the like. A purge valve 25 extends from the lower end of the body 10 and assists a snorkeler in clearing the body of water, as required. The purge valve 25, as is well known, is a one way flapper valve that is lightly loaded.

As best seen in FIG. 3, the mouthpiece has formed therein a pair of flexible lips 26 at the entrance of passageway 28. These flexible lips are collapsible by pressure from the lips of a snorkeler when articulating sounds, such as plosive sounds. As seen in FIG. 2, a bubble 18 is formed in one side of passageway 28 for facilitating rapid closure of the lips 26 with minimal effort of the snorkeler. The bubble 18 will "pop" inside out with the application of mild force from the lower lip of the snorkeler to close the air passage. This facilitates fairly normal speech movements which are impeded if large lip forces are required. It will be appreciated that the need to breathe imposes substantial limitations on the minimal throat and lip opening and poses the additional requirement that the lips be biased to an open position. Thus the provision of the bubble 18 significantly reduces the force required to close the flexible lips for forming plosive sounds without compromising the "open bias" of the flexible lips.

It will be further appreciated by those skilled in the art that the invention introduces into the water higher frequency sounds to balance the lower and mid frequency sounds that are already present. As mentioned, these latter sounds are readily coupled to the water from the snorkel mouthpiece, body and tube (and from the snorkeler's throat, chest, etc.) and create the intelligibility problems discussed above.

By supplying the higher frequency sounds, the masking effect of the introduction of the glottal and low frequencies is balanced to aid in communicating intelligible speech.

What has been described is a novel underwater voice communication snorkel that solves many of the problems of the prior art devices. It is recognized that numerous changes in the described embodiment of the invention will be apparent to those skilled in the art without departing from its true spirit and scope. The invention is to be limited only as defined in the claims.

What is claimed is:

1. A snorkel for enabling vocal communication under water comprising:

a hollow body;

a breathing tube, adapted to extend above the surface of water, coupled to said hollow body;

mouthpiece means coupled to said hollow body and adapted to be held by the mouth of a snorkeler;

flexible means in said mouthpiece means for enabling articulation of sounds by the lips of said snorkeler; and diaphragm means in said hollow body tuned in the range of 1500 to 3000 Hertz, in water, for augmenting coupled sound from said hollow body to the water.

2. The snorkel of claim 1 wherein said flexible means is adapted to be closed by pressure from the lips of said snorkeler for generating plosive sounds.

3. The snorkel of claim 1, wherein said diaphragm means include a plurality of diaphragms in said hollow body, each tuned to different portions of said frequency range.

4. The snorkel of claim 3 wherein said different portions of said frequency range overlap.

5. The snorkel of claim 2 wherein said mouthpiece means includes a passageway coupled to said hollow body and a readily collapsible bubble formed in a surface of said passageway and adapted for engagement with the lower lip of said snorkeler.

6. The snorkel of claim 5 wherein said mouthpiece means further includes a pair of bits adapted to be engaged by the teeth of said snorkeler.

7. The snorkel of claim 1 wherein said diaphragm means comprises an inwardly curved dome of thin plastic material secured in said hollow body.

8. The snorkel of claim 1 wherein said diaphragm means comprises a multiplicity of inwardly curved domes secured in said hollow body.

9. A snorkel for enabling underwater vocal communication comprising:

a hollow body;

a breather tube, adapted to extend above the surface of water, coupled to said hollow body;

mouthpiece means, including a passageway having a pair of flexible lips adapted to be closed by the lips of a snorkeler for articulating plosive and other sounds, coupled to said hollow body; and diaphragm means, tuned to resonate in the range of 1500 to 3000 Hertz, in water, secured to said hollow body for augmenting the sound coupled from said hollow body to said water.

10. The snorkel of claim 1 wherein a readily collapsible bubble is formed in said passageway for engagement with the lower lip of said snorkeler.

11. Mouthpiece means, including a passageway for enhancing underwater vocal communications, comprising:

a pair of flexible lips in said passageway for enabling articulation of plosive sounds therein; and a readily collapsible bubble formed in a surface of said passageway engaged by the lower lip of a person.

* * * * *